US010448797B2

(12) United States Patent
Gregorich et al.

(10) Patent No.: US 10,448,797 B2
(45) Date of Patent: Oct. 22, 2019

(54) VACUUM CLEANER

(71) Applicant: TTI (MACAO COMMERCIAL OFFSHORE) LIMITED, Macau (MO)

(72) Inventors: Brent Gregorich, Anderson, SC (US); Brandon Causey, Greenville, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 136 days.

(21) Appl. No.: 15/297,362

(22) Filed: Oct. 19, 2016

(65) Prior Publication Data

US 2018/0103811 A1 Apr. 19, 2018

(51) Int. Cl.
*A47L 7/00* (2006.01)
*A47L 9/00* (2006.01)
(Continued)

(52) U.S. Cl.
CPC ..... *A47L 7/0019* (2013.01); *A47L 5/365* (2013.01); *A47L 9/009* (2013.01); *A47L 9/0027* (2013.01); *A47L 9/0081* (2013.01); *A47L 9/102* (2013.01); *A47L 9/127* (2013.01); *A47L 9/1409* (2013.01); *A47L 9/22* (2013.01); *A47L 9/2884* (2013.01)

(58) Field of Classification Search
CPC ..... A47L 5/362; A47L 9/2842; A47L 9/242; A47L 5/365; A47L 9/00; A47L 7/0019; A47L 9/0027; A47L 9/0081; A47L 9/009; A47L 9/102; A47L 9/127; A47L 9/1409
See application file for complete search history.

(56) References Cited

U.S. PATENT DOCUMENTS 1,986,976 A 1/1935 Kitto
2,296,359 A 9/1941 Martinet
(Continued)

FOREIGN PATENT DOCUMENTS

EP 2000070 2/2012
KR 20130115529 A 10/2013
KR 101491968 B1 2/2015

OTHER PUBLICATIONS

European Patent Office Search Report for Application No. 17197185.6 dated May 7, 2018, 8 pages.
(Continued)

*Primary Examiner* — Roberts J Scruggs
(74) *Attorney, Agent, or Firm* — Michael Best & Friedrich LLP

(57) ABSTRACT

A vacuum cleaner including a debris collection container having an outer perimeter and a lid removably coupled to the debris collection container. The lid has a periphery that extends along the outer perimeter of the debris collection container. The vacuum further includes a suction source coupled to the lid and removable from the debris collection container with the lid. The suction source includes a motor and an impeller driven by the motor. The vacuum cleaner further includes an exhaust passageway downstream from the suction source for discharging an airflow from the debris collection container. The exhaust passageway extends radially outward from the impeller and toward the periphery of the lid. The vacuum cleaner further includes an exhaust outlet port in communication with the exhaust passageway. The exhaust outlet port extends along a majority of the periphery of the lid.

18 Claims, 6 Drawing Sheets

(51) Int. Cl.

| | |
|---|---|
| ***A47L 5/36*** | (2006.01) |
| ***A47L 9/14*** | (2006.01) |
| ***A47L 9/28*** | (2006.01) |
| ***A47L 9/10*** | (2006.01) |
| ***A47L 9/12*** | (2006.01) |
| ***A47L 9/22*** | (2006.01) |

(56) References Cited

U.S. PATENT DOCUMENTS

| | | | | |
|---|---|---|---|---|
| 2,486,619 | A | 11/1949 | Troxler | |
| 2,693,312 | A | 11/1954 | Lanter | |
| 2,726,807 | A | 12/1955 | Lewis | |
| 2,884,185 | A | 4/1959 | Dolan | |
| 3,940,826 | A | 3/1976 | Phillips et al. | |
| 4,114,231 | A | 9/1978 | Nauta | |
| 4,120,616 | A | 10/1978 | Dwyer et al. | |
| 4,651,380 | A * | 3/1987 | Ogden | A47L 5/22 15/321 |
| 4,682,384 | A | 7/1987 | Prahl et al. | |
| 5,129,124 | A | 7/1992 | Gamou et al. | |
| 5,353,469 | A * | 10/1994 | Fellhauer | A47L 7/0028 15/326 |
| 5,560,078 | A | 10/1996 | Toensing et al. | |
| 5,850,668 | A | 12/1998 | Berfield et al. | |
| 5,984,632 | A | 11/1999 | Lee et al. | |
| 6,003,200 | A | 12/1999 | Potts et al. | |
| RE36,627 | E | 3/2000 | Pink et al. | |
| 6,145,160 | A | 11/2000 | Buss et al. | |
| 6,146,094 | A | 11/2000 | Obana et al. | |
| 6,219,880 | B1 * | 4/2001 | Worden | A47L 5/365 15/327.6 |
| 6,311,366 | B1 | 11/2001 | Sepke et al. | |
| 6,442,792 | B1 | 9/2002 | Sudou et al. | |
| 6,481,049 | B1 | 11/2002 | Berfield | |
| 6,484,354 | B2 | 11/2002 | Lee | |
| 6,592,329 | B1 | 7/2003 | Hirose et al. | |
| 7,320,151 | B2 | 1/2008 | Oka | |
| 8,152,488 | B2 | 4/2012 | Fang | |
| 8,397,344 | B2 | 3/2013 | Liddell | |
| 8,590,103 | B2 | 11/2013 | Wolfe, Jr. | |
| 8,806,703 | B2 | 8/2014 | Bassett | |
| 9,271,620 | B2 | 3/2016 | Meredith et al. | |
| 9,408,509 | B2 | 8/2016 | Plato et al. | |
| 2006/0059655 | A1 | 3/2006 | Lau | |
| 2006/0127240 | A1 | 6/2006 | Lee et al. | |
| 2006/0280596 | A1 | 12/2006 | Kim et al. | |
| 2011/0277267 | A1 | 11/2011 | Nakamura et al. | |
| 2012/0317748 | A1 | 12/2012 | Van Der Kooi et al. | |
| 2015/0074936 | A1 | 3/2015 | Plato et al. | |
| 2015/0182083 | A1 * | 7/2015 | Frank | A47L 5/365 15/352 |
| 2016/0032938 | A1 | 2/2016 | Hayamitsu | |
| 2016/0102675 | A1 | 4/2016 | Holsten | |

OTHER PUBLICATIONS

Australian Patent Office Examination Report for Application No. 2014248494 dated May 11, 2018, 6 pages.

* cited by examiner

VACUUM CLEANER

BACKGROUND

The invention relates to vacuum cleaner, and more particularly to wet/dry and utility vacuum cleaners.

SUMMARY

The invention provides, in one aspect, a vacuum cleaner including a debris collection container having an outer perimeter and a lid removably coupled to the debris collection container. The lid has a periphery that extends along the outer perimeter of the debris collection container. The vacuum further includes a suction source coupled to the lid and removable from the debris collection container with the lid. The suction source generates an airflow to draw air and debris into the debris collection container. The suction source includes a motor and an impeller driven by the motor. The vacuum cleaner further includes an exhaust passageway downstream from the suction source for discharging the airflow from the debris collection container. The exhaust passageway extends radially outward from the impeller and toward the periphery of the lid. The vacuum cleaner further includes an exhaust outlet port in communication with the exhaust passageway. The exhaust outlet port extends along a majority of the periphery of the lid.

The invention provides, in another aspect, a vacuum cleaner including a debris collection container having an outer perimeter and a lid removably coupled to the debris collection container. The lid has a periphery that extends along the outer perimeter of the debris collection container. The vacuum further includes a suction source coupled to the lid and removable from the debris collection container with the lid. The suction source generates an airflow to draw air and debris into the debris collection container. The suction source includes a motor and an impeller driven by the motor. The vacuum cleaner further includes an exhaust passageway downstream from the suction source for discharging the airflow from the debris collection container. The exhaust passageway extends radially outward from the impeller and toward the periphery of the lid. The vacuum cleaner further includes an exhaust outlet port in communication with the exhaust passageway. The exhaust outlet port extends through an angle of at least 270-degrees around the periphery of the lid.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
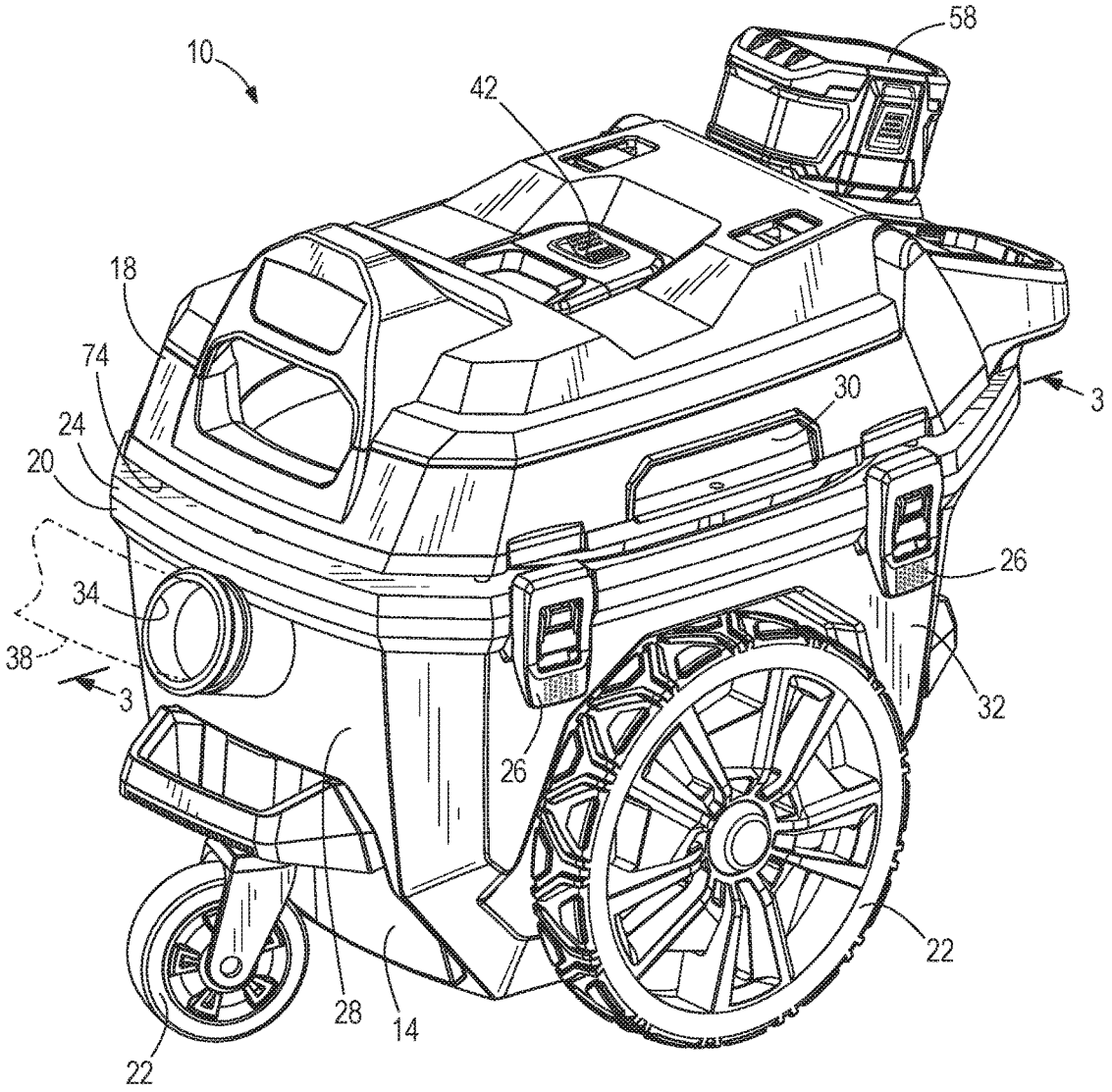
FIG. 1 is a front perspective view of a vacuum cleaner in accordance with an embodiment of the invention.
Figure 2:
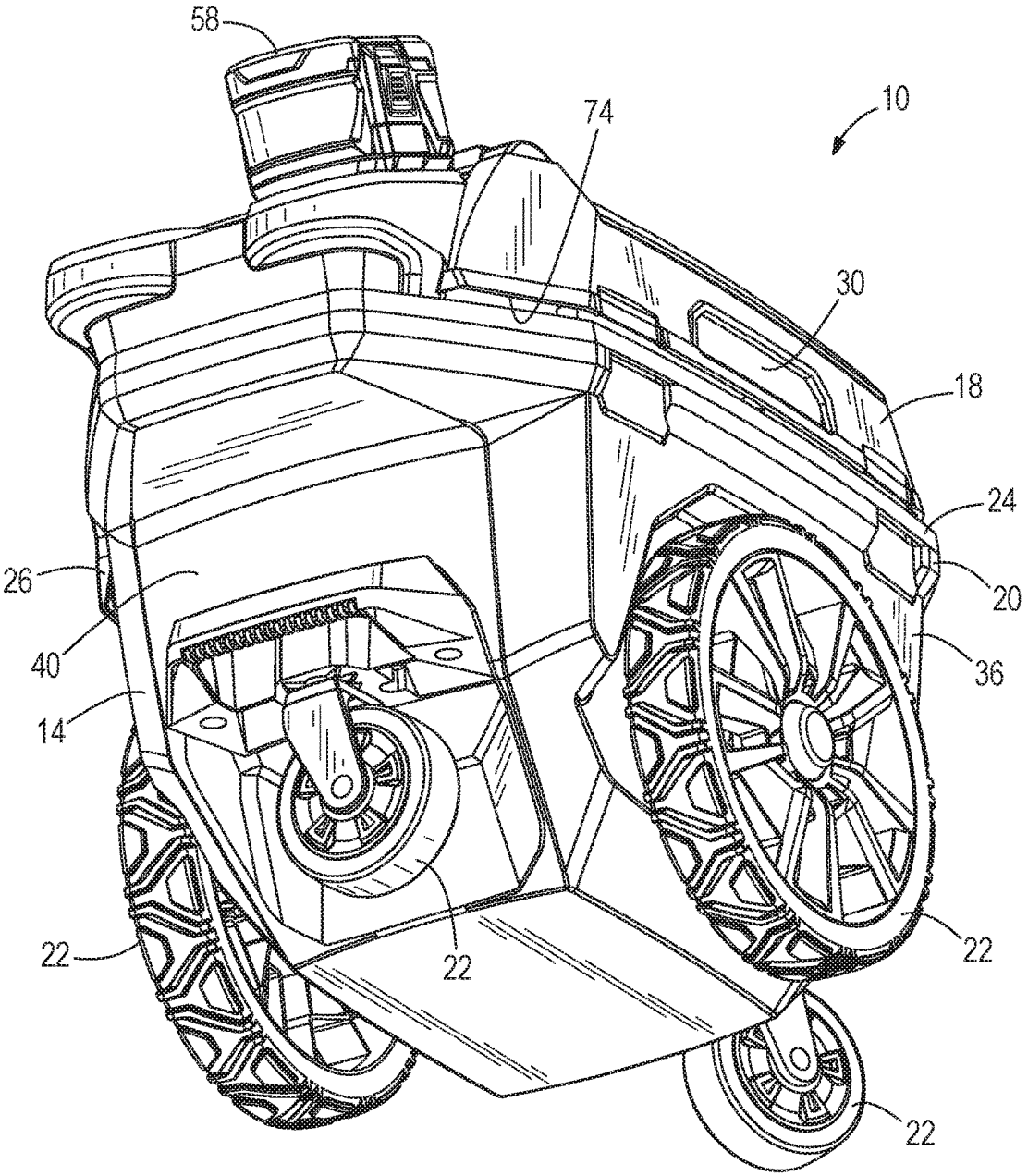
FIG. 2 is rear perspective view of the vacuum cleaner of FIG. 1.
Figure 4:
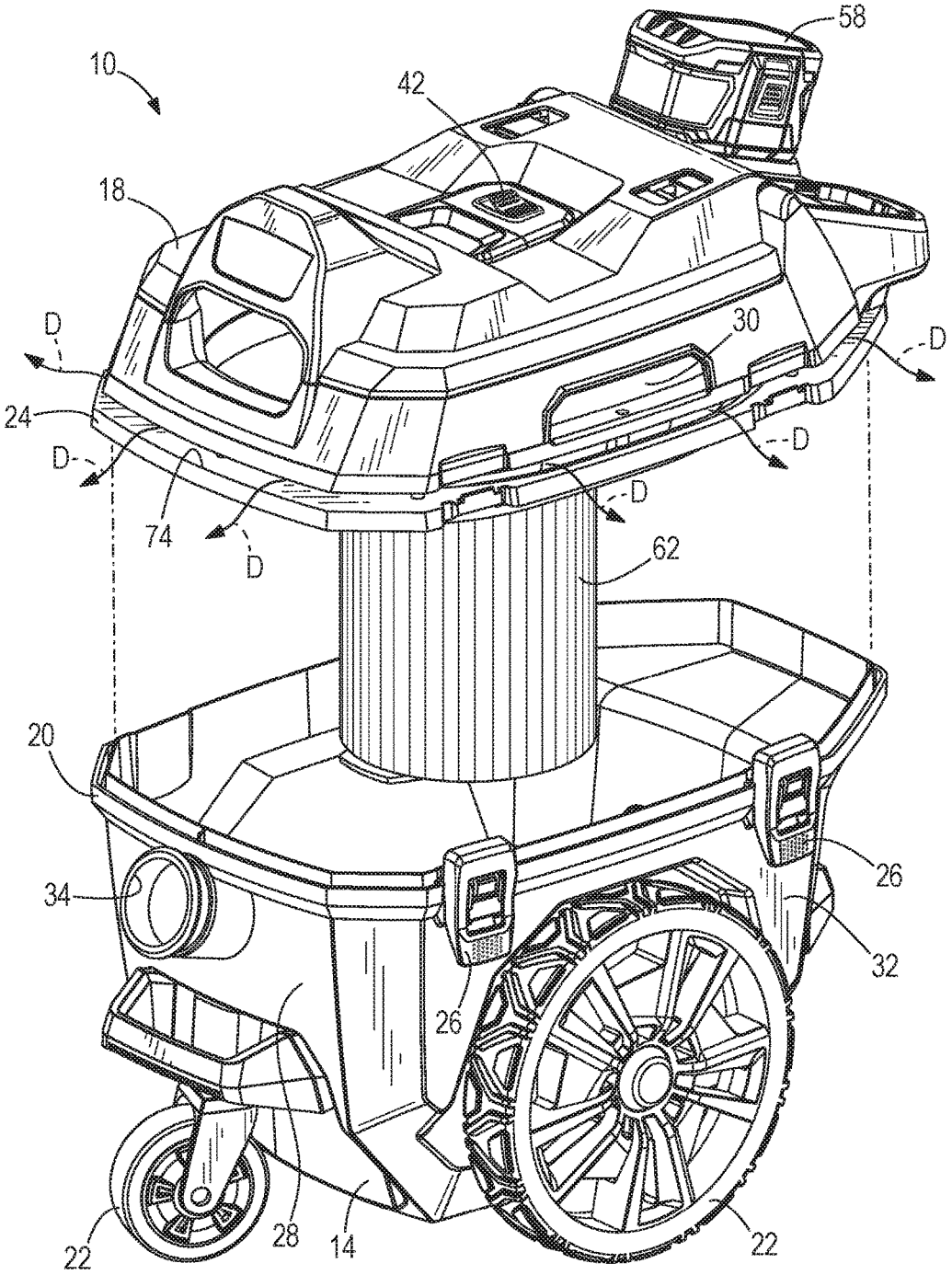
FIG. 4 is an exploded perspective view of the vacuum cleaner, illustrating a lid of the vacuum cleaner exploded from a container of the vacuum cleaner.

FIGS. 1 and 2 illustrate a vacuum cleaner 10 including a debris collection container 14 and a lid 18. The debris collection container 14 collects and stores debris and includes an outer perimeter 20. The container 14 also includes a first wall 28, a second wall 32, a third wall 36, and a fourth wall 40 such that the container 14 is generally square or cube-shaped. The lid 18 is removably coupled to the container 14 and includes a periphery 24. Specifically, the outer perimeter 20 of the container 14 engages with and couples to the periphery 24 of the lid 18. The vacuum cleaner 10 further includes a plurality of wheels 22 rotatably coupled to the container 14. The wheels 22 support the vacuum cleaner 10 for movement along a support surface. The vacuum cleaner 10 further includes a series of latches 26 that are coupled to the container 14 and engageable with the lid 18. The latches 26 are movable between a locked state, in which the lid 18 is coupled to the container 14 (FIG. 1), and an unlocked state, in which the lid 18 is permitted to be removed from the container 14 (FIG. 4). The lid 18 is provided with gripping regions 30 to allow an operator to grasp and maneuver the vacuum cleaner 10 (i.e., if the lid 18 is coupled to the container 14) or the lid 18 relative to the container 14 (i.e., if the lid 18 is not coupled to the container 14).

With continued reference to FIGS. 1 and 2, the vacuum cleaner 10 further includes an inlet port 34 that extends into the debris collection container 14. The inlet port 34 allows debris and air to enter the debris collection container 14. A flexible nozzle 38 is coupled to the inlet port 34 to extend the inlet port 34 to a cleaning surface. The flexible nozzle 38 is movable relative to the vacuum cleaner 10 and may receive an accessory tool. When the accessory tools are not coupled to the nozzle, the accessory tools are stored on or within the vacuum cleaner 10.

Figure 3:
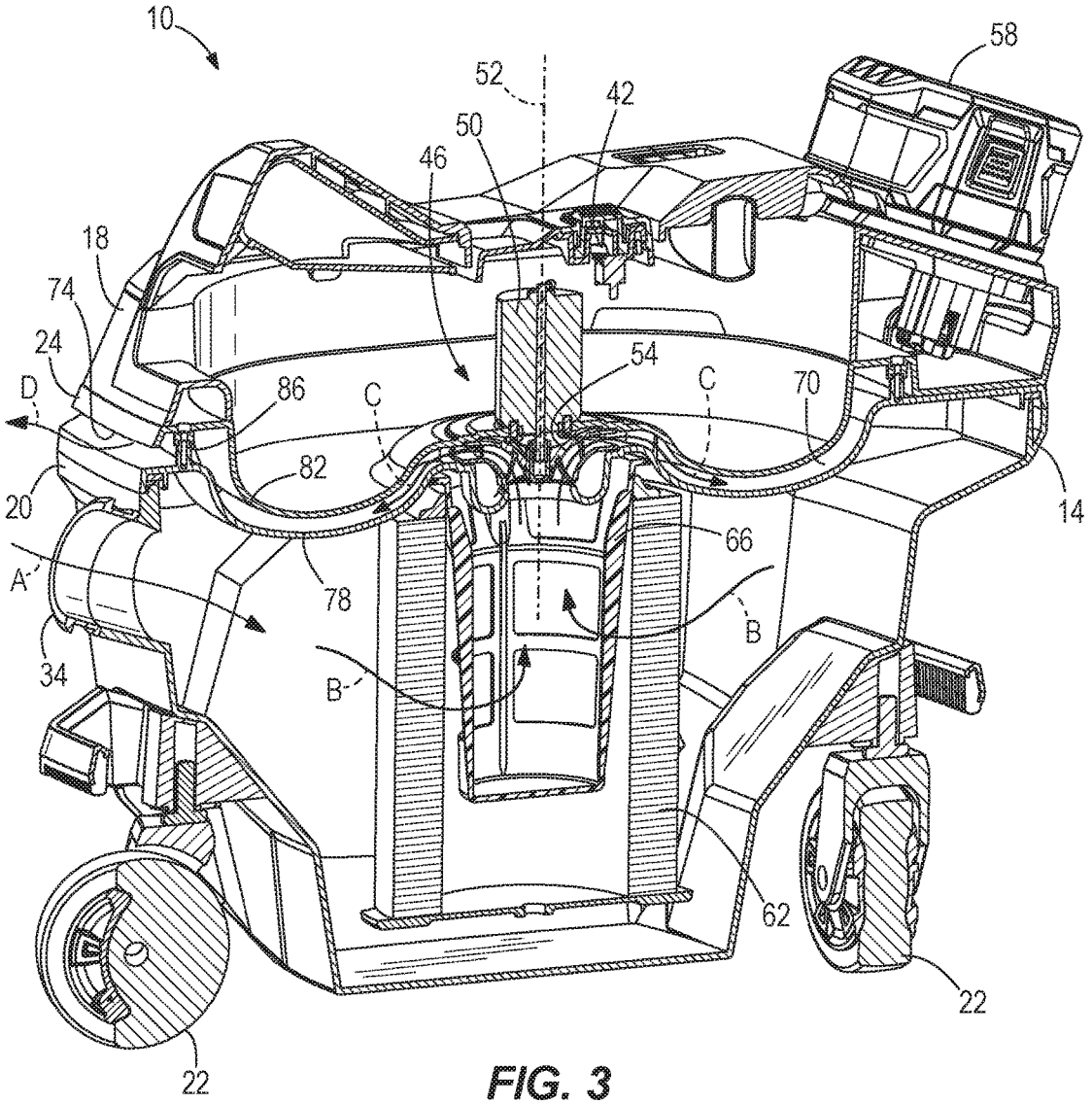
FIG. 3 is a cross sectional view taken along line 3-3 of FIG. 1.

With reference to FIG. 3, the vacuum cleaner 10 further includes a suction source 46 coupled to the lid 18. The suction source 46 generates an airflow to draw air and debris into the debris collection container 14. The suction source 46 includes a motor 50 and an impeller 54 (FIG. 5) rotatably driven by the motor 50. The motor 50 rotates about a drive axis 52 when the motor 50 is supplied with power via a power source, such as batteries 58 (although only one battery is shown). As the motor 50 is activated, the impeller 54 is also driven about the drive axis 52. As such, a region of low pressure is created within the debris collection container 14, thereby drawing air and debris into the container 14 through the nozzle 38 and the inlet port 34. In this particular embodiment, the batteries 58 are electrically connected in series in order to supply the motor 50 with power. Although the motor 50 of the illustrated embodiment draws power from the batteries 58, in other embodiments, the motor 50 could draw power from other electrical sources (e.g., wall outlet, generator, etc.).

With continued reference to FIG. 3, the vacuum cleaner 10 further includes a filter 62 that is disposed within the debris collection container 14. The filter 62 separates the debris from the air that enters the container 14. In one embodiment, the filter 62 is micro-porous to enable passage of air through the filter 62 and to allow discharge of air from the vacuum 10 while inhibiting passage of debris through the filter 62. Therefore, debris is collected via the nozzle 38, is blocked from being discharged from the vacuum cleaner 10 via the filter 62, and is stored in the container 14. In the illustrated embodiment, a cage 66 is located within the filter 62 to inhibit the filter 62 from collapsing on itself due to the low pressure region within the container 14. Also, in some embodiments, the cage 66 encases a float (not shown) that is operable to inhibit passage of fluid through the suction source 46 if the container 14 is filled with liquid. Also, the vacuum cleaner 10 can be provided with a sensor to detect an upright position of the vacuum cleaner 10, in which power is supplied to the motor 50, and a leaned or tipped over position, in which power is not supplied to the motor 50.

Figure 5:
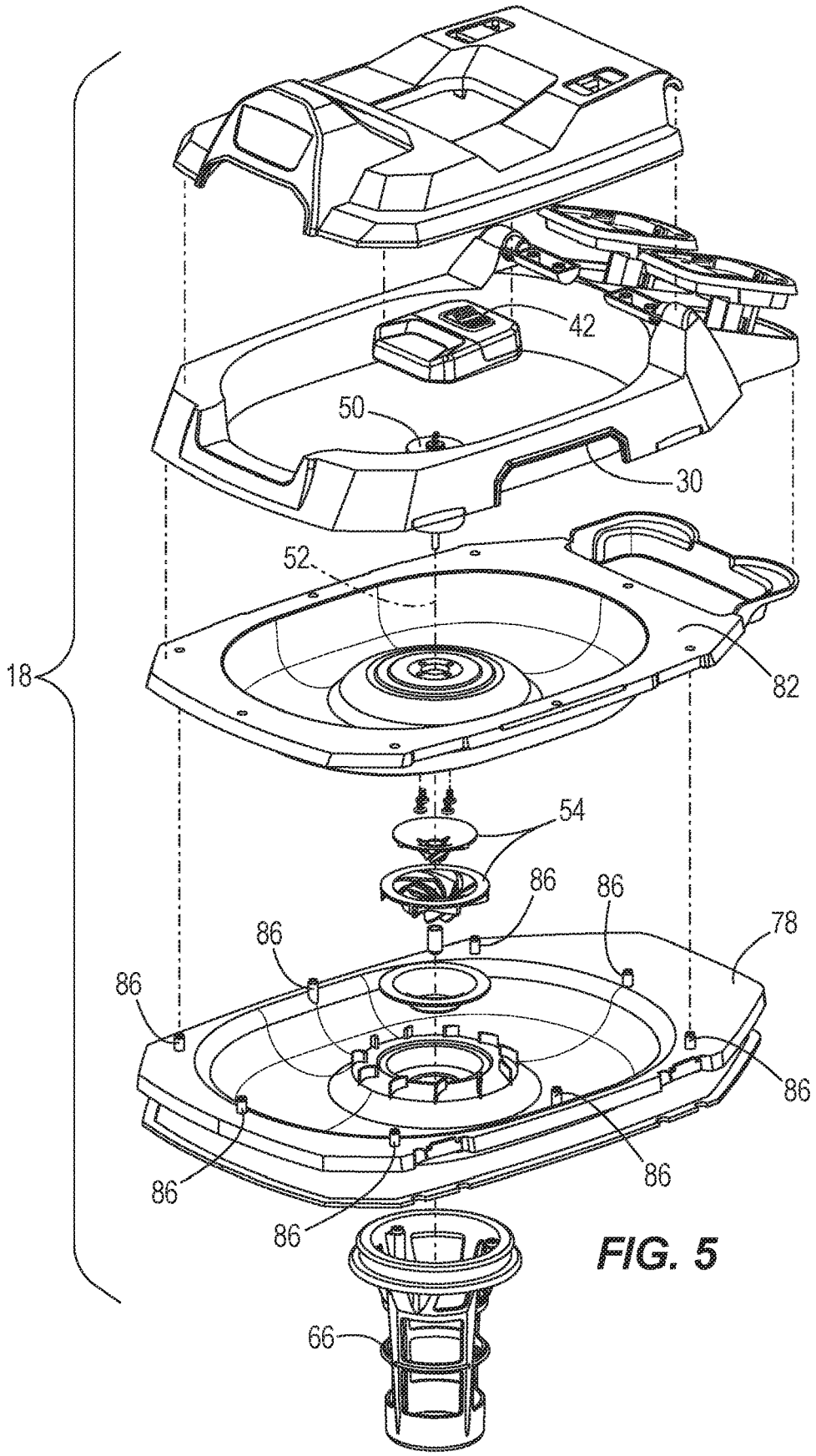
FIG. 5 is an exploded perspective view of the lid of the vacuum cleaner.

With reference to FIGS. 3-5, the vacuum cleaner 10 further includes an exhaust passageway 70 that discharges air from the debris collection container 14. The exhaust passageway 70 is downstream of the suction source 46 and is coupled to the lid 18. In other words, the exhaust passageway 70 remains with the lid 18 even when the lid 18 is removed from the container 14, as shown in FIG. 4. The exhaust passageway 70 is oriented substantially perpendicular to the drive axis 52 and extends radially 360-degrees outward from the suction source 46 toward the periphery 24 of the lid 18. The exhaust passageway 70 extends to an exhaust outlet port 74 that is disposed at the periphery 24 of the lid 18. The exhaust outlet port 74 extends along a majority of the periphery 24 of the lid 18. In particular, the exhaust outlet port 74 extends along the periphery 24 of the lid 18 adjacent the first wall 28, the second wall 32, and the third wall 36 of the container 14. As a result, the exhaust outlet port 74 extends through angle 76 along the periphery 24 of the lid 18. In the illustrated embodiment of FIG. 6, the angle 76 is greater than or equal to 270-degrees. As shown in FIGS. 3 and 5, the exhaust passageway 70 is formed via a lower housing 78 and an upper housing 82 spaced away from the lower housing 78. The lower housing 78 and the upper housing 82 are spaced away from each other by a plurality of posts 86 (FIG. 5). As illustrated, at least a portion of the impeller 54 is disposed within the exhaust passageway 70.

Figure 6:
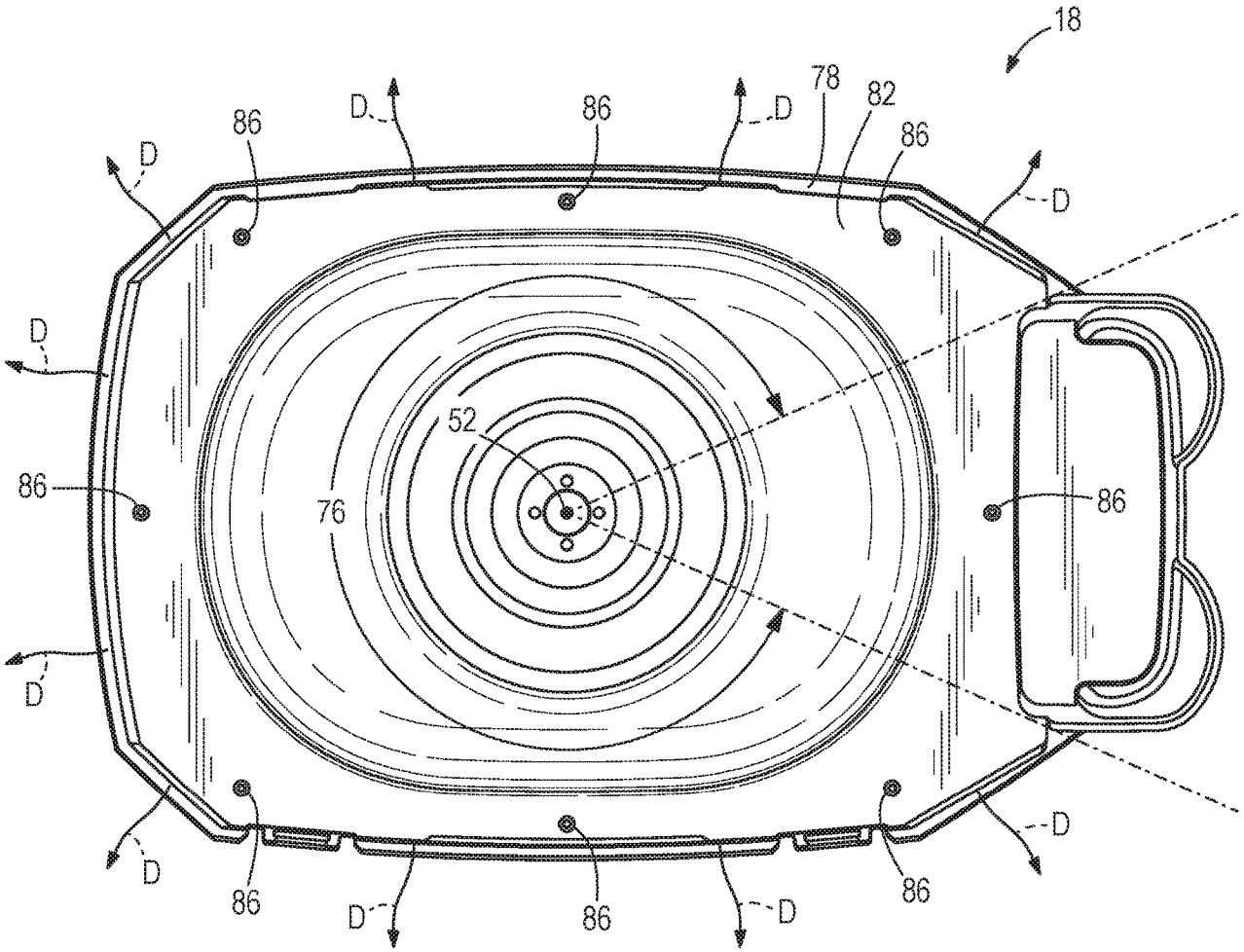
FIG. 6 is a top view of a portion of the lid of the vacuum cleaner.

Although the debris collection container 14 is shown as being square or cube-shaped, the exhaust outlet port 74 is described as extending through angle 76 (i.e., greater than or equal to 270-degrees) around the periphery 24 of the lid 18 because the exhaust passageway 70 extends radially 360-degrees from the impeller 54. Therefore, the discharged air is also being expelled radially outward at 360-degrees around the impeller 54 through the exhaust passageway 70. As shown in FIG. 6, the angle 76 is measured using the drive axis 52 as the center point to measure the angle 76 between the beginning of the exhaust outlet port 74 and the end of the exhaust outlet port 74. In other embodiments, the debris collection container 14 can be alternatively shaped (e.g., circular or tubular).

In operation, the motor 50 is activated which in turn drives the impeller 54. The batteries 58 selectively supply power to the motor 50 via a power switch 42. Once the impeller 54 begins to rotate, air and debris are drawn into the debris collection container 14 along arrow A (FIG. 3) via the nozzle 38 and the inlet port 34. Subsequently, the filter 62 separates the debris from the air and the debris is stored in the container 14. The air passes through the filter 62 along arrow B (FIG. 3) and travels upward toward the impeller 54. After passing through the impeller 54, the air is discharged away from the impeller 54 along the exhaust passageway 70. Illustrated in FIG. 3, arrow C shows the air traveling along a curvilinear path within the exhaust passageway 70 where the air is finally discharged through the exhaust outlet port 74 at the periphery 24 of the lid 18 as shown by arrow D. The air of arrow D is being discharged adjacent the first, second, and third walls 28, 32, 36 of the container 14. The contour and shape (i.e., curvilinear path and 360-degree radial exhaust configuration) of the exhaust passageway 70 diffuses the velocity and the sound of the discharged air.

Various features of the invention are set forth in the following claims.

What is claimed is:

1. A vacuum cleaner comprising:

a debris collection container having an outer perimeter;

a lid removably coupled to the debris collection container, the lid having a periphery that extends along the outer perimeter of the debris collection container, the lid further having an upper housing and a lower housing;

a suction source coupled to the lid and removable from the debris collection container with the lid, the suction source generates an airflow to draw air and debris into the debris collection container, the suction source including a motor, and an impeller driven by the motor;

an exhaust passageway downstream from the suction source for discharging the airflow from the debris collection container, the exhaust passageway extends radially outward from the impeller and toward the periphery of the lid, and at least a portion of the exhaust passageway comprising a curvilinear path defined by a surface of the upper housing of the lid and a complementary surface of the lower housing of the lid, the curvilinear path having a substantially uniform thickness as the exhaust passageway extends radially outward from the impeller and toward the periphery of the lid; and an exhaust outlet port in communication with the exhaust passageway, the exhaust outlet port extends along a majority of the periphery of the lid.

2. The vacuum cleaner of claim 1, wherein the debris collection container includes a first wall, a second wall, a third wall, and a fourth wall, and wherein the exhaust outlet port extends along periphery of the lid adjacent the first wall, the second wall, and the third wall of the debris collection container.

3. The vacuum cleaner of claim 1, wherein the exhaust passageway is coupled to the lid such that the exhaust passageway is removable with the lid from the debris collection container.

4. The vacuum cleaner of claim 1, further comprising a filter disposed within the debris collection container for separating debris from the airflow.

5. The vacuum cleaner of claim 1, further comprising a power source to supply power to the motor, and wherein the power source includes a plurality of batteries connected in series for supplying power to the motor.

6. The vacuum cleaner of claim 5, wherein the plurality of batteries are coupled to the lid and removable with the lid from the debris collection container.

7. The vacuum cleaner of claim 1, wherein the motor rotates the impeller about a rotational axis, and wherein the exhaust passageway is substantially perpendicular to the rotational axis of the impeller.

8. The vacuum cleaner of claim 1, wherein the exhaust outlet port is disposed at an outermost periphery of the lid.

9. The vacuum cleaner of claim 1, wherein the exhaust outlet port extends continuously along a majority of the periphery of the lid.

10. A vacuum cleaner comprising:

a debris collection container having an outer perimeter;

a lid removably coupled to the debris collection container, the lid having a periphery that extends along the outer perimeter of the debris collection container, the lid further having an upper housing and a lower housing;

a suction source coupled to the lid and removable from the debris collection container with the lid, the suction source generates an airflow to draw air and debris into the debris collection container, the suction source including a motor, and an impeller driven by the motor;

an exhaust passageway downstream from the suction source for discharging the airflow from the debris collection container, the exhaust passageway extends radially outward from the impeller and toward the periphery of the lid, and at least a portion of the exhaust passageway comprising a curvilinear path defined by a surface of the upper housing of the lid and a complementary surface of the lower housing of the lid, the surface of the lower housing being spaced substantially evenly from the surface of the upper housing; and an exhaust outlet port in communication with the exhaust passageway, the exhaust outlet port extends through an angle of at least 270 degrees around the periphery of the lid.

11. The vacuum cleaner of claim 10, wherein the motor rotates the impeller about a rotational axis, and wherein the exhaust passageway is substantially perpendicular to the rotational axis of the impeller.

12. The vacuum cleaner of claim 11, wherein the angle is measured about the rotational axis between ends of the exhaust outlet port.

13. The vacuum cleaner of claim 11, wherein the exhaust passageway extends radially 360-degrees outward about the rotational axis from the impeller.

14. The vacuum cleaner of claim 10, wherein the exhaust passageway is coupled to the lid such that the exhaust passageway is removable with the lid from the debris collection container.

15. The vacuum cleaner of claim 10, further comprising a power source to supply power to the motor, and wherein the power source includes a plurality of batteries connected in series for supplying power to the motor.

16. The vacuum cleaner of claim 15, wherein the plurality of batteries are coupled to the lid and removable with the lid from the debris collection container.

17. The vacuum cleaner of claim 10, wherein the exhaust outlet port extends continuously through an angle of at least 270 degrees around the periphery of the lid.

18. A vacuum cleaner comprising:

a debris collection container having an outer perimeter;

a lid removably coupled to the debris collection container, the lid having a periphery that extends along the outer perimeter of the debris collection container, the lid further having an upper housing and a lower housing;

a suction source coupled to the lid and removable from the debris collection container with the lid, the suction source generates an airflow to draw air and debris into the debris collection container, the suction source including a motor, and an impeller driven by the motor;

an exhaust passageway downstream from the suction source for discharging the airflow from the debris collection container, the exhaust passageway extends radially outward from the impeller and toward the periphery of the lid, the exhaust passageway defined by the upper housing and the lower housing, and at least a portion of the upper housing and at least a portion of the lower housing are disposed in the debris collection container; and an exhaust outlet port in communication with the exhaust passageway, the exhaust outlet port defined by the upper housing and the lower housing.

* * * * *